US008166608B2

(12) United States Patent
Becker et al.

(10) Patent No.: US 8,166,608 B2
(45) Date of Patent: May 1, 2012

(54) FLOOR TREATMENT DEVICE HAVING A ROTATABLE ROLLER

(75) Inventors: Diethard Becker, Bielefeld (DE); Michael Poetting, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 872 days.

(21) Appl. No.: 12/199,287

(22) Filed: Aug. 27, 2008

(65) Prior Publication Data

US 2009/0056066 A1 Mar. 5, 2009

(30) Foreign Application Priority Data

Aug. 30, 2007 (DE) ..... 10 2007 040 948

(51) Int. Cl.
*A47L 5/00* (2006.01)

(52) U.S. Cl. ..... 15/372

(58) Field of Classification Search ..... 15/355, 15/356, 359, 360, 362, 368, 371, 372; *A47L 5/00*
See application file for complete search history.

(56) References Cited

U.S. PATENT DOCUMENTS

| | | | |
|---|---|---|---|
| 2,416,420 | A | 2/1947 | Taylor |
| 3,827,103 | A | 8/1974 | Nordeen et al. |
| 4,976,003 | A | 12/1990 | Williams |
| 2004/0172784 | A1 | 9/2004 | Downey et al. |

OTHER PUBLICATIONS

European Search Report for EP 08 01 4167, dated Oct. 26, 2010.

*Primary Examiner* — David Redding
(74) *Attorney, Agent, or Firm* — Leydig, Voit & Mayer, Ltd.

(57) ABSTRACT

A floor treatment device including a housing, a brush motor and a rotatable roller disposed in the housing. A suction mouth is disposed in a portion of the housing. The rotatable roller is driven by the brush motor and at least partially extends from the suction mouth. The rotatable roller is resiliently mounted in the housing such that the distance between an axis of rotation of the rotatable roller and the housing portion is variable.

7 Claims, 2 Drawing Sheets

FLOOR TREATMENT DEVICE HAVING A ROTATABLE ROLLER

CROSS REFERENCE TO RELATED APPLICATIONS

Priority is claimed to German patent application DE 10 2007 040 948.8, filed Aug. 30, 2007, which is hereby incorporated by reference herein.

FIELD

The present invention relates to a floor treatment device having a rotatable roller which is disposed in a housing and extends at least partially from a suction mouth located in a portion of the housing.

BACKGROUND

A floor treatment device having a rotatable roller may be used, for example, as a permanently mounted base unit of an upright vacuum cleaner, but may also be used as a floor nozzle for a canister, handheld, or stick vacuum cleaner. The roller is usually provided with bristles, but elastic lips or the like may also be used. The rotating brushes contribute to the cleaning performance of the vacuum cleaner, because they loosen the dirt from floor coverings and raise the fibers of carpets, so that the suction can reach the fiber base. Such rollers can be driven by an electric motor, a turbine disposed in the suction air stream, or a gear mechanism coupled to the carriage.

The distance of floor treatment devices can be adjusted by a foot pedal or a rotary knob. Users of such devices often forget or do not bother to use the adjustment feature. Because of this, the cleaning result and the required push force are not ideal, and the bristles may become worn. In some devices the roller height can be adjusted automatically. In the process, the floor covering being treated is detected by a vacuum sensor, and the distance between the roller and the floor is adjusted accordingly. Such an automatic system is complex and expensive. Moreover, it is only after a certain treatment time has elapsed that the system can reliably infer the type of floor covering present from the partial vacuum measured. Therefore, this system is too slow to respond to varying floor coverings.

SUMMARY

An aspect of the present invention is to provide a floor treatment device in which the distance between the roller and the floor can always be adjusted to a desirable value by simple means.

In an embodiment, the present invention provides a floor treatment device including a housing, a brush motor and a rotatable roller disposed in the housing. A suction mouth is disposed in a portion of the housing. The rotatable roller is driven by the brush motor and at least partially extends from the suction mouth. The rotatable roller is resiliently mounted in the housing such that the distance between an axis of rotation of the rotatable roller and the housing portion is variable.

BRIEF DESCRIPTION OF THE DRAWINGS

An exemplary embodiment of the present invention is described in detail below and shown in a schematic way in the drawings, in which.

DETAILED DESCRIPTION

The present invention relates to a floor treatment device having a rotatable roller which is disposed in a housing and extends at least partially from a suction mouth located in a portion of the housing, and which is driven by a brush motor, it being possible to vary the distance between the axis of rotation of the roller and said housing portion.

In an embodiment, the present invention is related to floor treatment devices in which the roller is driven by an electric motor. The distance of the roller from the floor affects the cleaning result. The higher the pressure applied to the floor, the higher the cleaning performance. The appropriate distance depends primarily on the floor covering being treated. For hard floors or low-pile carpets, the distance between the roller and the floor can be small, while for high-pile carpets, a larger distance can be selected.

In the present invention the roller is mounted resiliently within the housing. As a result of this, the distance between the roller and the floor covering may be automatically and quickly adjusted to a desired value. This is achieved with little technical effort and, therefore, the floor treatment device is less expensive than designs having a manual or sensor-controlled adjustment. In addition, the mechanical damping between the housing and the roller ensures smooth running and a pleasant, low-level sound. In an embodiment, the resilient mounting is accomplished by the roller being pressed by spring force onto the floor being treated.

In an embodiment, the roller is held laterally by pivotably and resiliently mounted pivoting arms. In this manner, a simple construction is achieved. When the axis of rotation of the drive shaft of the electric motor and the axis of rotation of the roller are spaced apart from each other, the axis of rotation of the drive shaft of the electric motor may coincide with the pivot axes of the pivoting arms. Thus, the distance between the drive shaft and the roller remains constant, which is often desirable when using drive belts or other gearing components.

Figure 1:
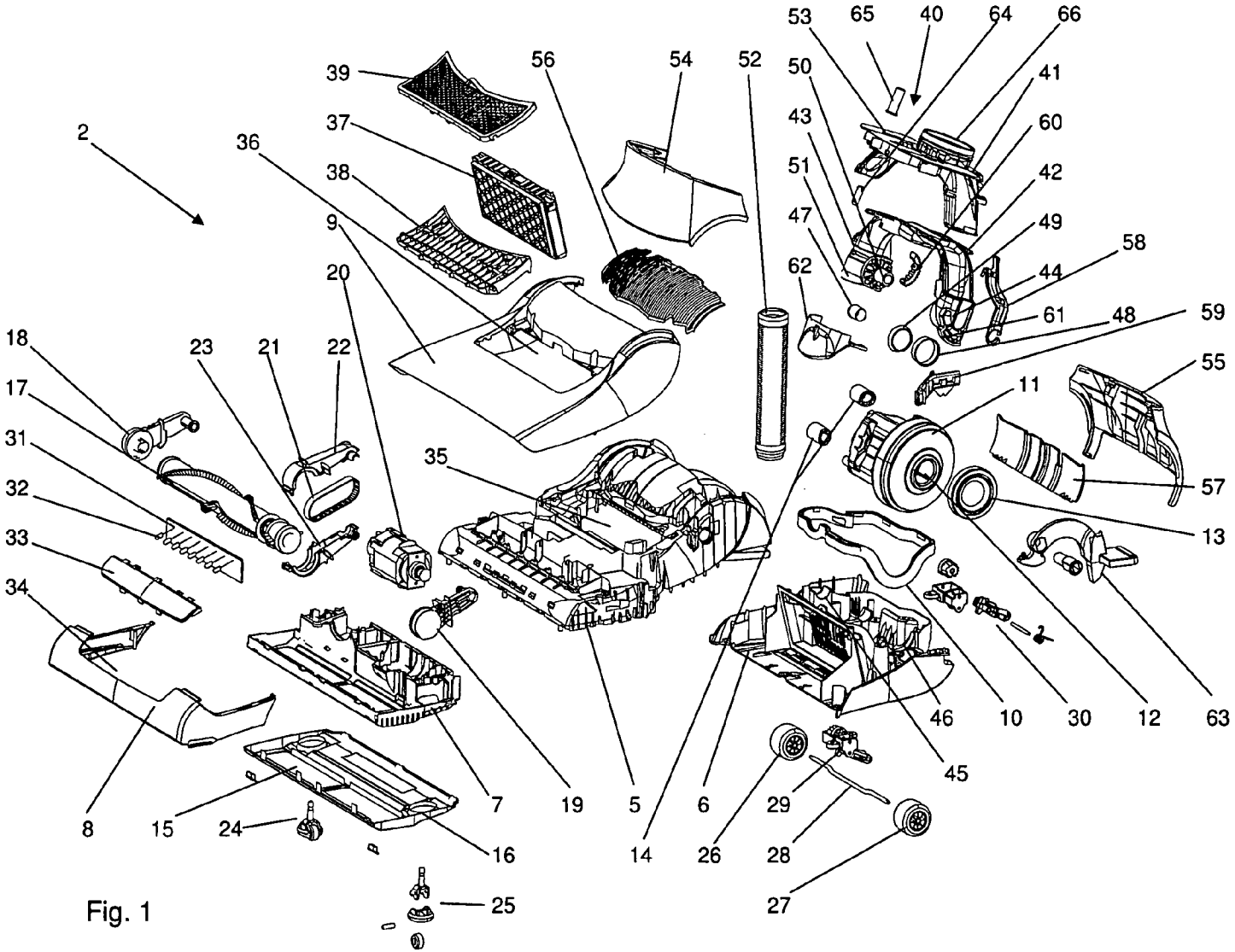
FIG. 1 is an exploded view showing the base unit of an upright vacuum cleaner.

FIG. 1 shows, in an exploded view, base unit 2 of an upright vacuum cleaner, the base unit having a housing including a housing insert 5, a lower rear housing part 6, a lower front housing part 7, a bumper strip 8, and a cover part 9. Housing insert 5 functions as a support for a number of electrical and mechanical components. The aforementioned housing parts are also attached thereto. The housing insert, lower rear housing part 6, and a motor chamber seal 10 placed therebetween, together form a chamber for receiving a motor/fan unit 11 for creating the partial vacuum required for vacuuming. A sealing ring 13 is provided around fan inlet 12 on the suction side, said sealing ring also bearing against the two aforementioned housing parts 5 and 6. Rubber buffers 14 are inserted on the opposite side. For deep cleaning of carpets, a brush roller 17 extends into suction mouth 15, which is an opening in lower front housing part 7 and bottom plate 16, which is attached thereto, said brush roller being resiliently mounted on two lateral pivoting arms 18 and 19 and being driven by a brush motor 20 via a belt 21. A two-part belt cover is provided by parts 22 and 23. Brush motor 20 is also attached to housing insert 5, and pivoting arms 18 and 19 are pivotably secured thereto. The carriage of the upright is formed by front casters 24 and 25 and rear wheels 26 and 27 and is supported by the two lower housing parts 6 and 7. Rear wheels 26 and 27 are connected by an axle 28 for purposes of stability, and are adjustable in position by means of a wheel mechanism 29 and 30, respectively. A circuit board 31 carrying LEDs 32 is secured to housing insert 5 to illuminate the travel path and is covered at the front by a transparent plate 33. Transparent plate 33 is held in a cut-out 34 in bumper strip 8.

The air generated by the motor/fan unit 11 is discharged into the environment through an opening 35 in housing insert 5 and a corresponding opening 36 in cover part 9. A filter frame 37 is inserted into opening 36 to hold an exhaust filter for removing ultrafine particles from the exhaust air. Filter frame 37 is covered by a grating holder 38 and a grating 39 within cover part 9, from where it can be replaced.

Both the tilting joint and the swivel joint between base unit 2 and an upper body are provided by a rigid, yoke-shaped duct member. This member also contains portions of the air passageway from suction mouth 15 to upper body 3, and the air passageway from upper body 3 to the exhaust port (openings 35 and 36). This member is hereinafter referred to as yoke 40. It is formed by two plastic parts, an upper shell 41 and a lower shell 42, which are welded together. In order to create the tilting joint, the two ends 43 (right) and 44 (left) of yoke 40 are pivotably mounted in openings 45 and 46 provided for this purpose, and are surrounded by metal bearing sleeves 47 and 48, respectively, in order to avoid wear. Yoke end 44, which is on the left side as viewed in the direction of travel, is hollow and is coupled to fan inlet 12 via a seal 49. A trunnion 50 is integrally formed with yoke end 43, which is on the right side as viewed in the direction of travel. Moreover, the right yoke end has an opening 51 which is connected by a flexible tube 52 to suction mouth 15. In order to prevent the interior of base unit 2 from becoming visible when tilting the upper body 3, the connecting portion between the two yoke ends 43 and 44 (hereinafter referred to as bridge portion 53) is enclosed by a front cover 54 and a rear cover 55, which are provided on base unit 2 and are capable of following the swivel motion of yoke 40. The gap between the front and rear covers and housing insert 5 is bridged by covering members 56 and 57. The first 58 of two cable ducts 58 and 59 is attached to left yoke end 44. Furthermore, yoke ends 43 and 44 carry toothed segments 60 and 61, which cooperate with wheel mechanisms 29 and 30. A covering cap 62 for a connecting cable is secured to bridge portion 53. To enable the upright to be locked in the upright position, a foot pedal 63 is mounted on housing insert 5 which, in this position, engages with left yoke end 44, thereby preventing yoke 40 from swiveling. The locked position can be released by depressing pedal 63. Moreover, in the locked position, swivel motion is prevented by two spring-mounted pins 64 and 65. In the region of bridge portion 53, the air passages provided by yoke ends 43 and 44 are combined into a first section 66 of a coaxial conduit.

Figure 2:
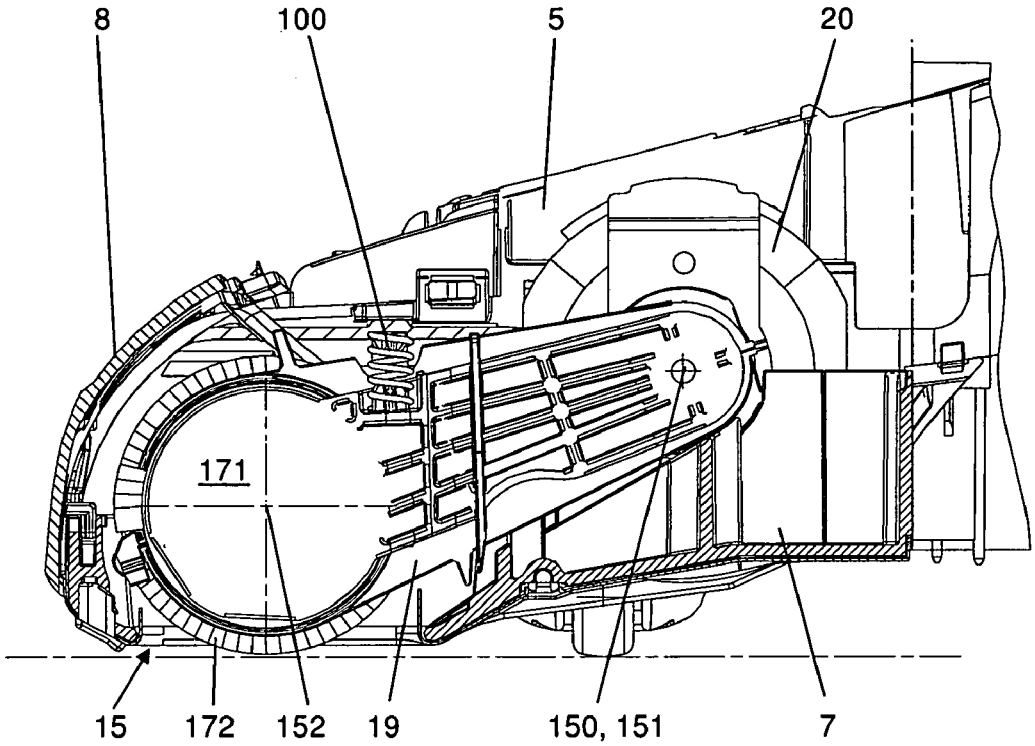
FIG. 2 is a cross-sectional view showing the components of the base unit of FIG. 1 in accordance with an embodiment of the invention.
Figure 3:
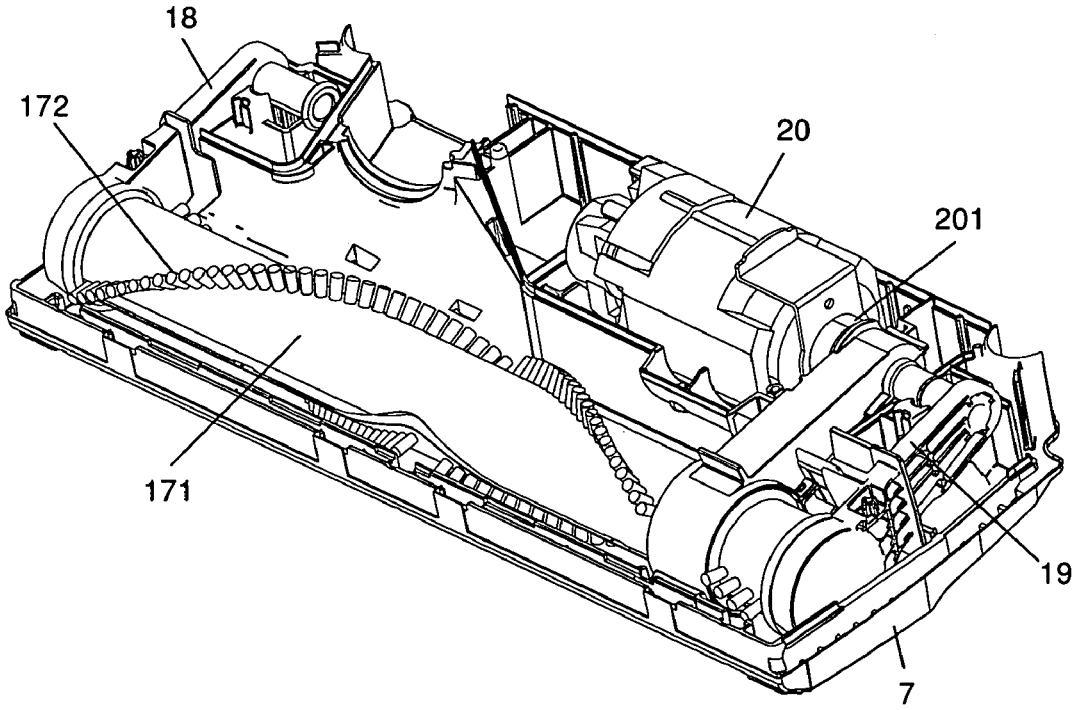
FIG. 3 is a perspective view, after removal of the housing cover, showing the components illustrated in FIG. 2.

In FIGS. 2 and 3, components of the invention are illustrated in a cross-sectional view (FIG. 2) and in a perspective view (FIG. 3). Shown here is only lower front housing part 7 of the housing of base unit 2; FIG. 2 additionally shows bumper strip 8 and portions of housing insert 5. Rotatable roller 171 is disposed within lower housing part 171. As shown particularly well in FIG. 2, the rotatable roller has bristles 172 arranged helically therearound, and is therefore also referred to as "brush roller". Roller 171 is mounted at both sides in pivoting arms 18 and 19 in such a manner that it can rotate about axis 152. Brush motor 20 is disposed in a recess provided for this purpose in lower front housing part 7. Its drive shaft 201 extends into cover 22, 23. The drive shaft carries a pinion gear driving a toothed belt 21, which in turn runs on a circumferentially toothed portion of roller 171 to drive the same. The two pivoting arms 18 and 19 are pivotably mounted in openings in lower front housing part 7, the pivot axes 151 of the two pivoting arms 18 and 19 coinciding with the axis of rotation 150 of drive shaft 201. Located between pivoting arms 18 and 19 and housing insert 5 are springs 100 which press the front portions of the pivoting arms 18 and 19, and thus roller 171, through suction mouth 15 onto the floor. The springs are selected to have a strength such that they are compressed when placed onto a long-pile commercial carpet, as a result of which roller 171 moves further away from the floor. This reduces the frictional forces exerted by bristles 172 on the carpet. Since roller 171 is resiliently mounted at both ends, the distance of the bristles can optimally adjust itself during cleaning of junctions between long-pile carpet and short-pile carpet (or smooth floor surfaces). Because drive shaft 201 and pivot axes 151 of the pivoting arms are disposed in coaxial relationship, it is ensured that toothed belt 21 performs the same angular movement as pivoting arms 18 and 19, and is therefore not subject to changes in length. Moreover, disposing the toothed belt laterally near a pivoting arm ensures that when pivoting arms 18 and 19 are deflected by different amounts, only small torsional forces will be exerted on toothed belt 21.

The present invention has been described herein based on one or more exemplary embodiments, but is not limited thereto. Reference should be had to the appended claims.

What is claimed is:

1. A floor treatment device comprising:

a housing having a suction mouth disposed in a portion of the housing;

a brush motor;

a rotatable roller disposed in the housing, driven by the brush motor and at least partially extending from the suction mouth, the rotatable roller being resiliently mounted in the housing such that a distance between an axis of rotation of the rotatable roller and the housing portion is variable; and pivoting arms that are pivotably and resiliently mounted in the housing, the pivoting arms laterally holding the rotatable roller;

wherein an axis of rotation of a drive shaft of the brush motor is spaced apart from the axis of rotation of the rotatable roller, and wherein the axis of rotation of the drive shaft of the brush motor coincides with a pivoting axis of the pivoting arms.

2. The floor treatment device as recited in claim 1 further comprising a spring configured to press the rotatable roller toward a floor by a spring force so as to provide the resilient mounting.

3. A flour treatment device comprising:

a housing having a suction mouth disposed in a portion of the housing;

a brush motor;

a rotatable roller disposed in the housing, driven by the brush motor and at least partially extending from the suction mouth, the rotatable roller being resiliently mounted in the housing such that a distance between an axis of rotation of the rotatable roller and the housing portion is variable;

pivoting arms that are pivotably and resiliently mounted in the housing, the pivoting arms laterally holding the rotatable roller; and a spring configured to press the rotatable roller onto a floor by a sprig force so as to provide the resilient mounting;

wherein an axis of rotation of a drive shaft of the brush motor is spaced apart from the axis of rotation of the rotatable roller, and wherein the axis of rotation of the drive shaft of the brush motor coincides with a pivoting axis of the pivoting arms.

4. The floor treatment device as recited in claim 1, wherein the floor treatment device is a vacuum cleaner.

5. A floor treatment device comprising:

a housing including a suction mouth;

a brush motor disposed in the housing and including a drive shaft having a drive shaft axis of rotation;

a pair of pivoting arms disposed in the housing and pivotable about a common pivoting axis; and a rotatable roller resiliently mounted in the housing and held by the pivoting arms, the rotatable roller at least partially extending from the suction mouth and configured such that a distance of the extension of the rotatable roller from the suction mouth is variable by pivoting of the pivot arms, wherein the drive shaft axis of rotation of the drive shaft of the brush motor coincides with a pivoting axis of the pivoting arms.

6. The floor treatment device as recited in claim 4, wherein the floor treatment device is a vacuum.

7. The floor treatment device as recited in claim 4 further comprising a spring coupled between the rotatable roller and the housing and configured to provide a spring force on the rotatable roller.

* * * * *